US008720103B2

(12) United States Patent
Schultz et al.

(10) Patent No.: US 8,720,103 B2
(45) Date of Patent: May 13, 2014

(54) FIREARM SCOPE MOUNT

(75) Inventors: Gregory R. Schultz, Marana, AZ (US); Nicholas H. Foy, Tucson, AZ (US)

(73) Assignee: Olive Tree Financial Group, L.L.C., Tucson, AZ (US)

( * ) Notice: Subject to any disclaimer, the term of this patent is extended or adjusted under 35 U.S.C. 154(b) by 0 days.

(21) Appl. No.: 13/606,957

(22) Filed: Sep. 7, 2012

(65) Prior Publication Data

US 2014/0068994 A1 Mar. 13, 2014

(51) Int. Cl.
*F41G 1/38* (2006.01)

(52) U.S. Cl.
USPC ..... 42/127; 42/124; 42/125

(58) Field of Classification Search
USPC ..... 42/124–128, 90
See application file for complete search history.

(56) References Cited

U.S. PATENT DOCUMENTS

| | | | | |
|---|---|---|---|---|
| 3,834,052 | A * | 9/1974 | Steck, III | 42/90 |
| 3,986,285 | A * | 10/1976 | Krisay | 42/127 |
| 4,878,307 | A * | 11/1989 | Singletary | 42/124 |
| 6,381,895 | B1 | 5/2002 | Keeney et al. | |
| 7,062,876 | B2 | 6/2006 | Wilson | |
| 7,481,016 | B2 * | 1/2009 | Gonzalez | 42/127 |
| 7,685,758 | B2 * | 3/2010 | Romer | 42/124 |
| 7,694,450 | B2 * | 4/2010 | Keng | 42/124 |
| 8,156,678 | B2 | 4/2012 | Hoel et al. | |
| D680,611 | S * | 4/2013 | Emde et al. | D22/103 |
| 8,522,469 | B2 * | 9/2013 | Baker | 42/90 |
| 2005/0132631 | A1 * | 6/2005 | Bodo | 42/118 |
| 2005/0229465 | A1 * | 10/2005 | Dextraze | 42/85 |
| 2005/0252060 | A1 * | 11/2005 | Gonzalez | 42/90 |
| 2006/0179703 | A1 * | 8/2006 | Leatherwood | 42/124 |
| 2007/0271834 | A1 | 11/2007 | Keng | |
| 2008/0072471 | A1 * | 3/2008 | Keng | 42/124 |
| 2010/0037505 | A1 * | 2/2010 | Romer | 42/124 |
| 2012/0131838 | A1 | 5/2012 | Edge et al. | |

OTHER PUBLICATIONS

AIM Sports, AK Double Side Rail Mount/Picatinny, http://www.bing.com/shopping/aim-sports-ak-double-side-rail-mount-picatinny/p/EE8EFE . . . , accessed Jun. 18, 2012.

Kalinka Optics Warehouse, POSP 2.5-5x24 Zoom Rifle Scope w/ 400 meter Simonov Reticle, Independent Focus, Tactical Weaver Rail and COMBO Tactical 240 mW Lasers, AK Version, http://kalinkaoptics.com/posp-2-5-5x24-d-zoom-rifle-scope-w-400-meter-simonov-reticle-independent-focus-combo-tac . . . , accessed Jun. 19, 2012.

Midway USA, Arsenal, Inc. Optimized Picatinny-Style Scope Mount Side Rail Matte, http://www.midwayusa.com/product/472718/arsenal-inc-optimized-picatinny-style-scope-mount-ak-47-ak-74-side-rail- . . . , accessed Jun. 19, 2012.

Texasweaponsystems, Dog LegTM Scope Rail / Gen-2/AK 47 & AK74 Variants, http://texasweaponsystems.com/, accessed Jun. 19, 2012.

The Country Shed, AK-47/MAC-90 Scope Mounts, http://www.thecountryshed.com/ak47_scope_mounts.htm, accessed Jun. 19, 2012.

(Continued)

*Primary Examiner* — Jonathan C Weber
(74) *Attorney, Agent, or Firm* — Stinson Leonard Street LLP

(57) ABSTRACT

A firearm scope mount that is operable to mount to a firearm having a receiver and a sight housing. The scope mount has a rear support that is operable to mount to a side of the receiver and a front support that is operable to mount to the sight housing. A rail is coupled with and extends between the front and rear supports.

18 Claims, 4 Drawing Sheets

(56) References Cited

OTHER PUBLICATIONS

Ultimak Enhanced Performance, Instructions for AK Stock Replacement, http://ultimak.com/akstockR&R.htm, accessed Jun. 19, 2012.

Samson Manufacturing Corp, AK-47 Rear Sight Rail, http://www.brownells.com/.aspx/pid=41209/Product/AK-47-REAR-SIGHT-RAIL, accessed on Jul. 1, 2012.

* cited by examiner

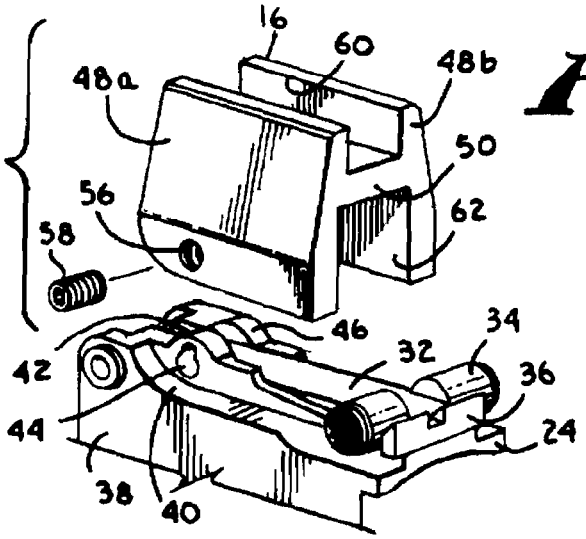
Fig.5.
Fig.6.
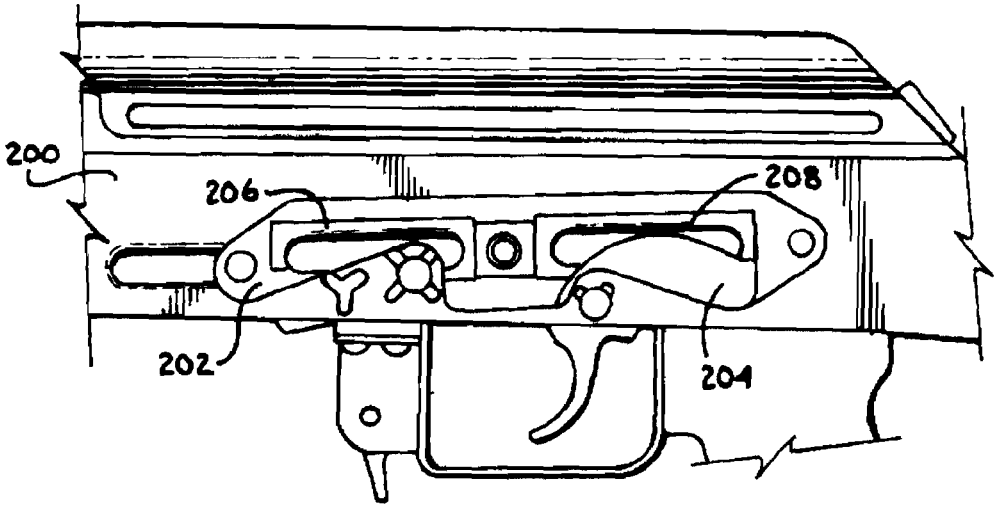
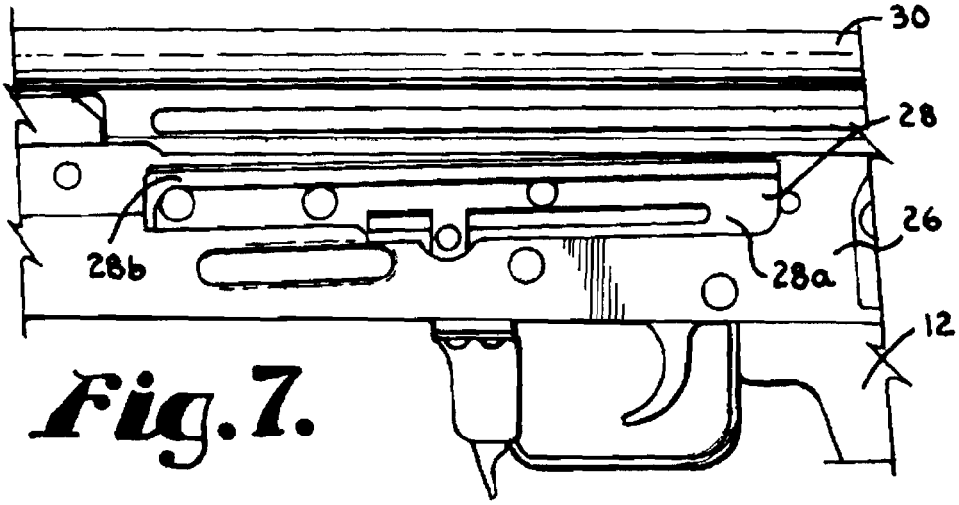
Fig.7.

FIREARM SCOPE MOUNT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention is directed to a firearm scope mount, and more specifically to a firearm scope mount operable to mount to a firearm's receiver and sight housing.

2. Description of Related Art

Many types of firearms developed in the former Soviet Union and surrounding countries do not include accessory mounting rails or convenient locations for mounting accessories, such as scopes. The type of firearm commonly referred to as Kalashnikov series firearms, which includes the AK-47 rifle, is one type of firearm that does not include an accessory mounting rail that is capable of mounting modern accessories to the firearm.

Kalashnikov series firearms typically have an aiming system that is commonly referred to as "iron-sights," which consists of a tangent style rear sight housing mounted to a forward end of the receiver and a post at the end of the barrel. The rear sight housing mounts a pivoting lever arm with a notched sight that is aligned with the post and target before firing. This type of aiming system, while crudely effective, does not provide the precision now sought by military personnel and sportsmen. Because of this, there have been various attempts to develop more modern scope mounting systems for Kalashnikov series firearms to improve a user's ability to aim one of the rifles.

An early Soviet attempt at a scope mounting system consists of a mounting bracket affixed to the left side of the rifle's receiver and a scope that mounts to the mounting bracket and extends, cantilevered over the top of the receiver. Because the scope only mounts to a single location on the rifle and is cantilevered over the top of the receiver, it frequently moves and becomes misaligned as the rifle is fired or bumped. Another type of aftermarket mount is a replacement dust or receiver cover that has an integral Weaver or Picatinny rail on its top surface. These mounts also frequently move and become misaligned because the dust cover of a Kalashnikov series firearm typically fits loosely on top of the receiver. Also, because the dust cover must be removed in order to clean and service the rifle, any scope mounted to the dust cover must be realigned after the dust cover is removed and replaced.

Other types of aftermarket mounts for Kalashnikov series firearms include replacement forearm, handguard, or gas tubes having integral Picatinny or Weaver style rails. These mounts are generally undesirable for use with a scope because they position the scope too far forward on the firearm for the shooter to use it comfortably and correctly. Further, these forward mounting locations are undesirable due to the heat and shock generated in these areas by repeated firing which can damage a scope.

Conventional mount systems for Kalashnikov series firearms also do not adequately support large and/or heavy optics such as the AN/PVS-4 night vision scope especially when the rifles are in fully automatic mode. Due to the insufficient support provided by conventional mount systems, large or heavy optics become misaligned as the firearms are moved or fired.

BRIEF SUMMARY OF THE INVENTION

The present invention is directed toward a firearm scope mount that is operable to mount to a firearm having a receiver and a sight housing. The scope mount has a rear support that is operable to mount to a side of the receiver and a front support that is operable to mount to the sight housing. A rail is coupled with and extends between the front and rear supports. Preferably, the front support is operable to mount to a tangent style rear sight housing, as is commonly found on a Kalashnikov series firearm, and the rear support is operable to mount to a protrusion on the left side of the receiver. However, it is within the scope of the invention for the front and rear supports to be configured to mount to different styles of sight housings and receivers, respectively. The front and rear supports are preferably operable to support the rail spaced a vertical distance above the receiver to permit removal of a cover from the top of the receiver. Preferably, the scope mount stiffens the firearm to prevent or resist twisting or flexing of the firearm as rounds are fired. The scope mount preferably rigidly mounts to the firearm to prevent movement of the scope mount and any accessories mounted thereon as rounds are fired.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

FIG. 5 is an exploded perspective view of the front support and sight housing shown in FIG. 4;

FIG. 6 is a side elevational view of a conventional AK-47 rifle side receiver mount;

FIG. 7 is a side elevational view of a conventional PSL rifle side receiver mount;

DETAILED DESCRIPTION OF PREFERRED EMBODIMENT

Figure 1:
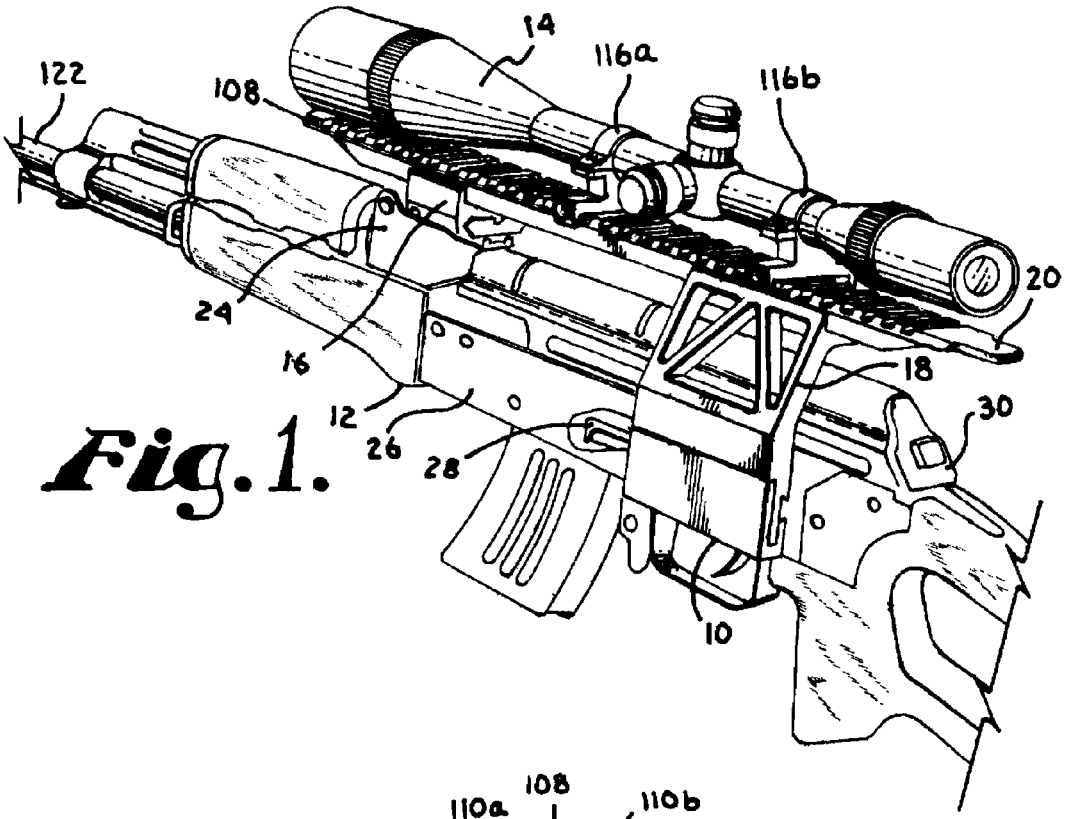
FIG. 1 is a perspective view showing a firearm scope mount in accordance with the present invention mounted on a rifle and with a scope mounted thereon.
Figure 3:
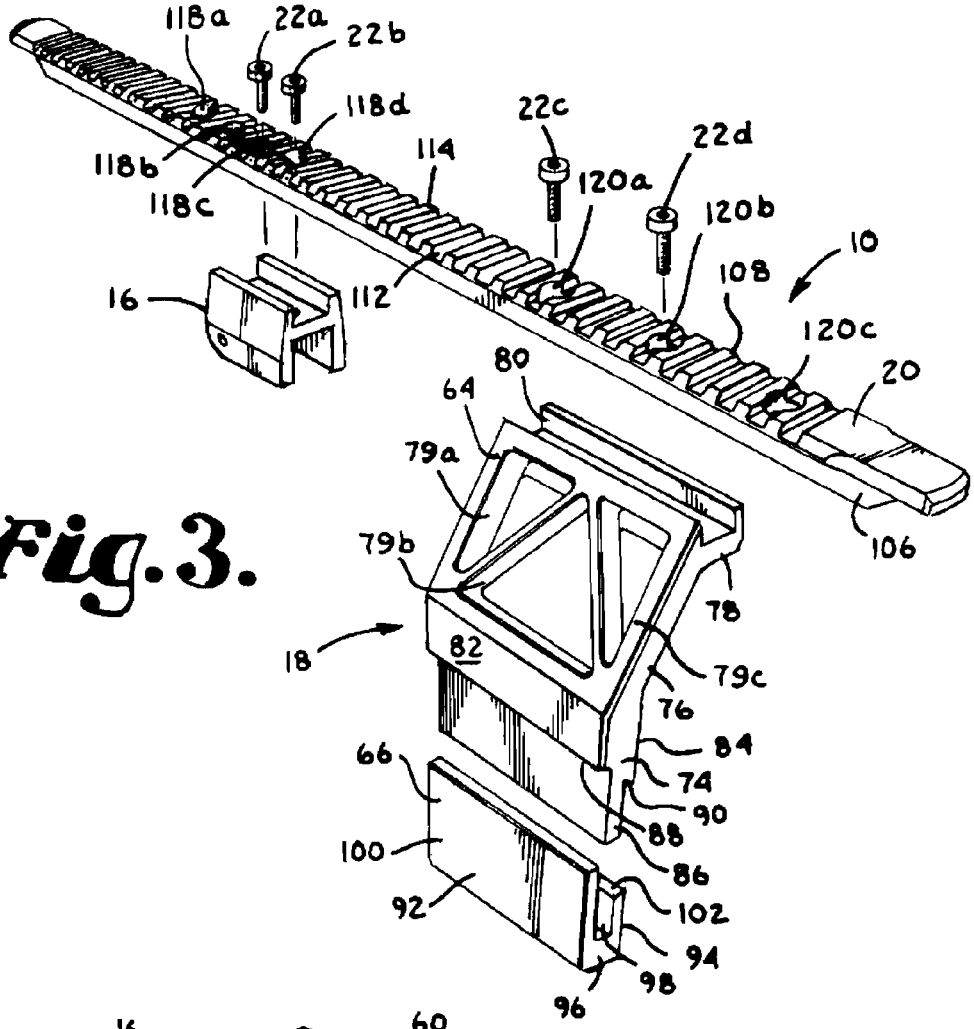
FIG. 3 is an exploded perspective view of the firearm scope mount.

A firearm scope mount in accordance with the present invention is generally shown as 10 in FIG. 1. The scope mount 10 is mounted to a firearm 12, and a scope 14 is mounted to the scope mount 10. Referring to FIG. 3, the scope mount 10 includes a front support 16, a rear support 18, and a rail 20 that is joined to and extends between the front and rear supports 16 and 18 with fasteners 22*a-d*. Referring to FIG. 1, front support 16 mounts to a sight housing 24 of firearm 12, and rear support 18 mounts to a side of a receiver 26 of firearm 12. Because the front and rear supports 16 and 18 are rigidly mounted to firearm 12 and rail 20 is rigidly mounted to front and rear supports 16 and 18, the scope mount 10 stiffens the receiver 26 and firearm 12 to reduce twisting and flexing of the firearm 12 and receiver 26 when a round is fired.

The scope mount 10 may be mounted to any type of firearm having a sight housing and receiver, such as the firearm 12 shown in FIG. 1 which is a Romanian PSL rifle. The scope mount 10 may be mounted to any type of Kalashnikov series firearm, which for purposes of this application means any type of firearm developed by Mikhail Kalashnikov of Russia or his design team, derived from or substantially based on a firearm developed by Mikhail Kalashnikov or his design team, or in some cases preceding and forming a partial basis for a firearm developed by Mikhail Kalashnikov or his design team, which includes but is not limited to the following firearms: AK-47, AK-74, AKM, RPK, PSL, SVD/Dragunov/Tiger, and Saiga shotgun. It is within the scope of the invention for minor modifications to be made to the scope mount 10 shown in the drawings to enable it to be mounted on any of the rifles specified above. Referring to FIG. 1, the PSL rifle and other Kalashnikov series firearms have a receiver 26 with a mounting structure 28 on the left side of the receiver 26. Referring to FIG. 7, the mounting structure 28 includes a vertical portion 28*a* that is joined to a left side wall of receiver 26 with rivets or by other suitable means and a horizontal portion 28*b*, or male dovetail joint portion, that is integral with and extends outward from vertical portion 28*a*. As shown in FIG. 1, the sight housing 24 is coupled with the receiver 26 such that it extends at least partially above the receiver 26. A dust cover 30 is removably joined to the top of the receiver 26.

The sight housing 24 forms a portion of what is commonly referred to as the "iron-sights" of the firearm 12. Referring to FIG. 5, as is known in the art, the sight housing 24 includes a pivoting lever 32 with a slideable barrel 34 mounted on it and a notched sight 36 joined to its end. As the barrel 34 slides forward, the lever 32 and notched sight 36 move upward for targeting objects that are farther away. Before firing, the notched sight 36 is aligned with a post (not shown) mounted to a forward portion of the firearm's barrel and the target. The sight housing 24 includes a left side wall 38 with a curved top surface 40. A left lever mounting wall 42 extends upward from the top surface 40 and presents a hole 44 which receives a pin (not shown) to rotatably mount the lever 32 to the wall 42. The sight housing 24 is symmetrical such that there is a right side wall (not shown) with a curved top surface (not shown). A right lever mounting wall 46 extends upward from the top surface and presents a hole (not shown) to receive a pin (not shown) for rotatably mounting the lever 32 to wall 46. A gap between the left and right lever mounting walls 42 and 46 receives a portion of lever 32. The type of sight housing 24 shown in the drawings and described above is commonly referred to as a tangent style rear sight housing.

Figure 4:
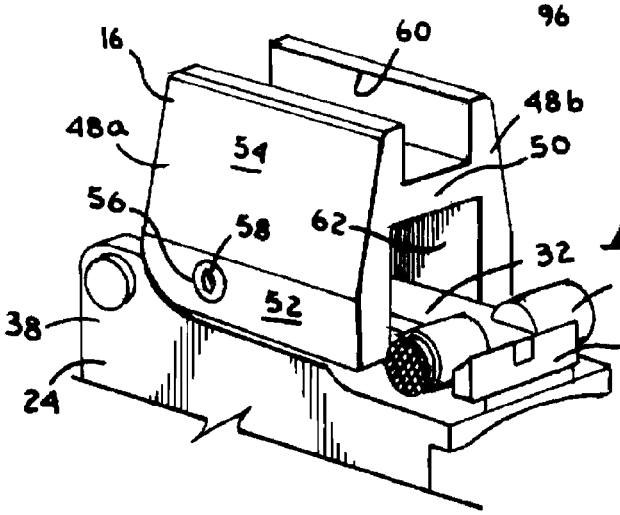
FIG. 4 is a close-up perspective view of a front support of the firearm scope mount mounted to a sight housing of a firearm.

Referring to FIG. 4, front support 16 has a pair of generally vertical legs 48*a* and 48*b* and a generally horizontal portion 50 integral with and extending between legs 48*a* and 48*b*. Each of the legs 48*a* and 48*b* is substantially similar. Thus, only leg 48*a* is discussed in detail herein. Leg 48*a* includes a lower section 52 with a vertical outer surface and an upper section 54 with an angled outer surface that tapers toward leg 48*b*. A threaded hole 56 in lower section 52 is aligned with the hole 44 (FIG. 5) of sight housing 24 and engages a threaded screw 58 that extends through the leg 48*a* and at least partially into hole 44 for mounting the front support 16 to the sight housing 24. Another threaded screw (not shown) engages a threaded hole (not shown) in leg 48*b* and extends through leg 48*b* into a hole (not shown) of the sight housing 24 for mounting the front support 16 to the sight housing 24. A lower surface of leg 48*a* is curved so that it closely conforms to the curved top surface 40 (FIG. 5) of sight housing 24. The lower surface of leg 48*b* is curved in a similar manner so that the front support 16 fits snugly on the sight housing 24 as shown in FIG. 4. The horizontal portion 50 is positioned such that there is a groove 60 having a rectangular cross-section positioned above the horizontal portion 50 between legs 48*a* and 48*b*. There is also a groove 62 having a rectangular cross-section positioned below the horizontal portion 50 between legs 48*a* and 48*b*. Groove 62 is slightly wider than groove 60 and is sized so that lever 32 fits within the groove 62 between legs 48*a* and 48*b*.

Figure 2:
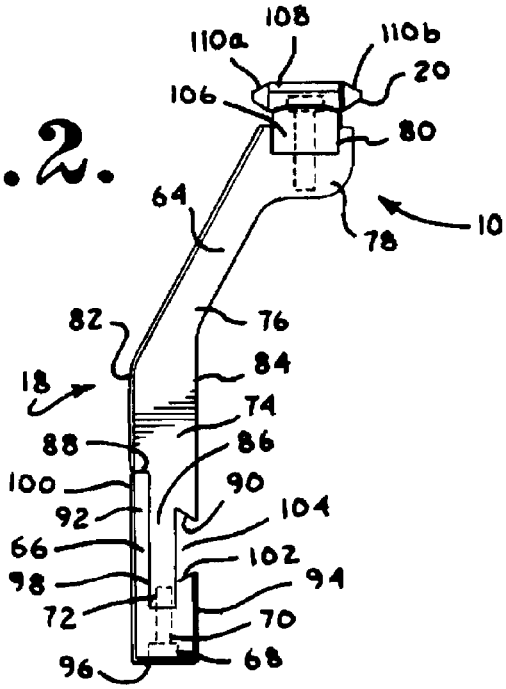
FIG. 2 is a rear elevational view of the firearm scope mount.

Referring to FIGS. 2 and 3, rear support 18 has an upper section 64 and a lower section 66 that is joined to the upper section 64 with two screws one of which is shown as 68 passing through an opening 70 (FIG. 2) in lower section 66 and engaging a threaded opening 72 in upper section 64. The other screw passes through a similar opening (not shown) in lower section 66 to engage a threaded opening in upper section 64. The upper section 64 includes a generally vertical lower portion 74, an angled portion 76 integral with and extending upward from the lower portion 74 at an angle, and a horizontal upper portion 78 integral with and extending from the angled portion 76. Weight reduction slots 79*a-c* are formed in the angled portion 76. A groove 80 having a rectangular cross-section is formed in the upper portion 78 for receiving a portion of rail 20. The vertical portion 74 has outer and inner walls 82 and 84, respectively. At a lower end of the vertical portion 74, there is a protrusion 86 having a rectangular cross-section and a thickness that is less than the remainder of the vertical portion 74. The protrusion 86 is horizontally offset from the outer wall 82 which forms a horizontal surface 88 between the protrusion 86 and outer wall 82. The protrusion 86 is also horizontally offset from the inner wall 84 which forms an angled surface 90 that angles upward from the inner wall 84 to the protrusion 86.

The lower section 66 of rear support 18 is generally J-shaped with first and second spaced apart vertical portions 92 and 94 joined by a lower horizontal portion 96. A rectangular groove 98 (FIG. 3) is positioned between the vertical portions 92 and 94 above the horizontal portion 96. The lower section 66 is configured so that it can slide on and off of the upper section 64. When the lower section 66 slides on the upper section 64, as shown in FIG. 2, groove 98 receives a portion of protrusion 86 and vertical portion 92 abuts horizontal surface 88 such that outer wall 82 is flush with an outer wall 100 of vertical portion 92. Vertical portion 94 has an angled upper surface 102 that angles downward from inner wall 84 to protrusion 86. The angled surfaces 90 and 102 along with protrusion 86 form a female dovetail joint portion 104. Screw 68 engages the threaded surface 72 in protrusion 86 to join the upper and lower sections 64 and 66 and clamp the horizontal portion 28*b*, or male dovetail joint portion, (FIG. 7) of receiver 26 within the female dovetail joint portion 104 to rigidly join the rear support 18 to the receiver 26. Because the rear support 18 has separate upper and lower sections 64 and 66, the upper section 64 may be placed above the horizontal portion 28*b* of receiver 26 before the lower section 66 slides on the upper section 64 beneath the horizontal portion 28*b*. When the rear support 18 is mounted to the receiver 26, as shown in FIG. 1, the horizontal upper portion 78 is positioned over the top of the dust cover 30 and is vertically spaced from the dust cover 30 to permit removal of the dust cover 30. The groove 80 in rear support 18 is aligned with the center of the firearm 12 and with the groove 60 in front support 16 when the front and rear supports 16 and 18 are mounted to the firearm 12.

Referring to FIG. 2, rail 20 includes a lower section 106 having a rectangular cross-section and an upper section 108 integral with and extending upward from the lower section 106. The lower section 106 is sized for being received by the groove 60 of front support 16 and the groove 80 of rear support 18. The upper section 108 is shaped like a conventional Picatinny or Weaver style rail having angled sides 110*a-b* and a top surface with alternating grooves 112 and ridges 114 shown in FIG. 3. As shown in FIG. 1, conventional scope rings 116*a* and 116*b* mount to the upper section 108 to rigidly mount scope 14 to the scope mount 10. Because the upper section 108 is shaped like a conventional Picatinny or Weaver style rail, any type of conventional firearm accessory configured for mounting to one of those styles of rails may be mounted to the scope mount 10. It is also within the scope of the invention for the rail 20 to have a different configuration so that other types of firearm accessories may mount to it.

Referring to FIG. 3, there are four holes 118*a-d* in a forward portion of the rail 20 that are configured for receiving screws 22*a* and 22*b* for mounting the rail 20 to front support 16. Front support 16 includes two threaded holes (not shown) that receive the screws 22*a* and 22*b* each of which is received by one of the holes 118*a-d*. The position of the rail 20 with respect to the firearm 12 may be adjusted by choosing which of the holes 118*a-d* receive screws 22*a* and 22*b*. There are three holes 120*a-c* in a rearward portion of the rail 20 that are configured for receiving screws 22*c* and 22*d* for mounting the rail 20 to rear support 18. Rear support 18 includes two threaded holes (not shown) that receive the screws 22*c* and 22*d* each of which is received by one of the holes 120*a-c*. The position of the rail 20 with respect to the firearm 12 may be adjusted by choosing which of the holes 120*a-c* receive screws 22*c* and 22*d*.

When the rail 20 is mounted to the front and rear supports 16 and 18 and the front and rear supports 16 and 18 are mounted to the firearm 12 as shown in FIG. 1, the rail 20 is substantially parallel with a barrel 122 of the firearm 12 and the rail 20 is centered with respect to the barrel 122 so that it is equidistant from left and right sides of the barrel 122. Because the rail 20 is aligned with the barrel 122 in this manner, when scope 14 is mounted to the rail 20 it may be aligned with the barrel 122 to enhance the accuracy of a shooter using the scope 14 and firearm 12. The rail 20 is spaced a distance above the dust cover 30 of the firearm 12 so that the dust cover 30 may be removed without removing the scope mount 10 and scope 14, which allows a user to quickly service the firearm 12 without removing, replacing and realigning the scope 14. The rail 20 is rigidly mounted to the front and rear supports 16 and 18, which are rigidly mounted to the firearm 12 to prevent the rail 20 and scope 14 from moving as the firearm 12 is fired so that the scope 14 does not need to be realigned after firing. Due to the configuration of the scope mount 10 and the rigid mounting of the front and rear supports 16 and 18 to the firearm 12, heavy and/or large optics and accessories, such as the AN/PVS-4 night vision scope which weighs approximately 4 pounds, may be mounted to the scope mount 10 and not become misaligned even when the firearm 12 is fired in fully automatic mode. Preferably, the scope mount 10 is operable to support optics or accessories in excess of 64 ounces even during fully automatic fire.

Figure 8:
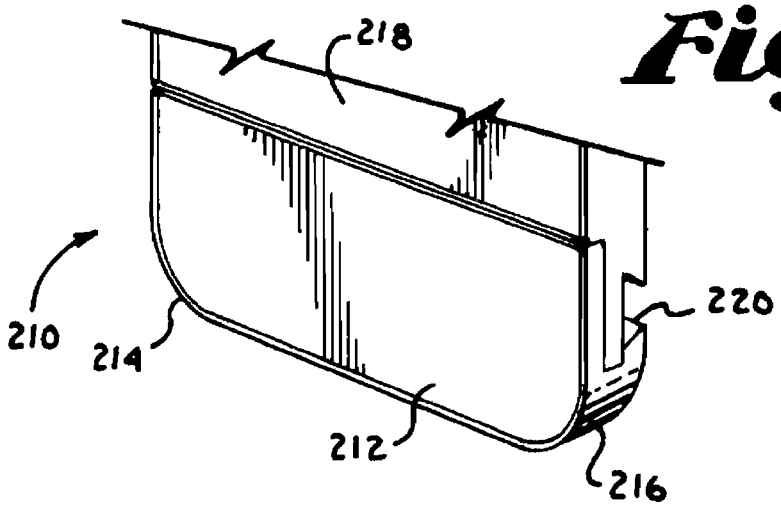
FIG. 8 is a partial side elevational view of an alternative rear support for use with the AK-47 receiver shown in FIG. 6.

Referring to FIG. 6, a receiver 200 of an AK-47 rifle is shown. Receiver 200 has a mounting structure 202 that is slightly different from the mounting structure 28 of the PSL rifle shown in FIGS. 1 and 7. The mounting structure 202 includes a vertical portion 204 that is joined to a left side wall of receiver 200 with rivets or by other suitable means and a pair of horizontal portions 206 and 208, or male dovetail joint portions, that are integral with and extend outward from vertical portion 204. The horizontal portions 206 and 208 of the AK-47 receiver 200 shown in FIG. 6 are closer to the rifle's trigger than the horizontal portion 28*b* of the PSL receiver 26 shown in FIG. 7. Thus, an alternate version of rear support 210 shown in FIG. 8 is preferably used for mounting to AK-47 receiver 200. Rear support 210 is substantially identical to rear support 18 except that the lower section 212 of rear support 210 has rounded corners 214 and 216 which creates more clearance for a shooter to access the trigger and grip the firearm. Rear support 210 has an upper section 218 that is substantially similar to the upper section 64 of rear support 18 (FIG. 3). The upper section 218 is joined to the lower section 212 in substantially the same manner as described above with respect to the upper and lower sections 64 and 66 of rear support 18. The lower and upper sections 212 and 218 combine to form a female dovetail joint portion 220, similar to female dovetail joint portion 104 of rear support 18, that is operable to receive and clamp either of the horizontal portions 206 and 208 for mounting to receiver 200.

Figure 9:
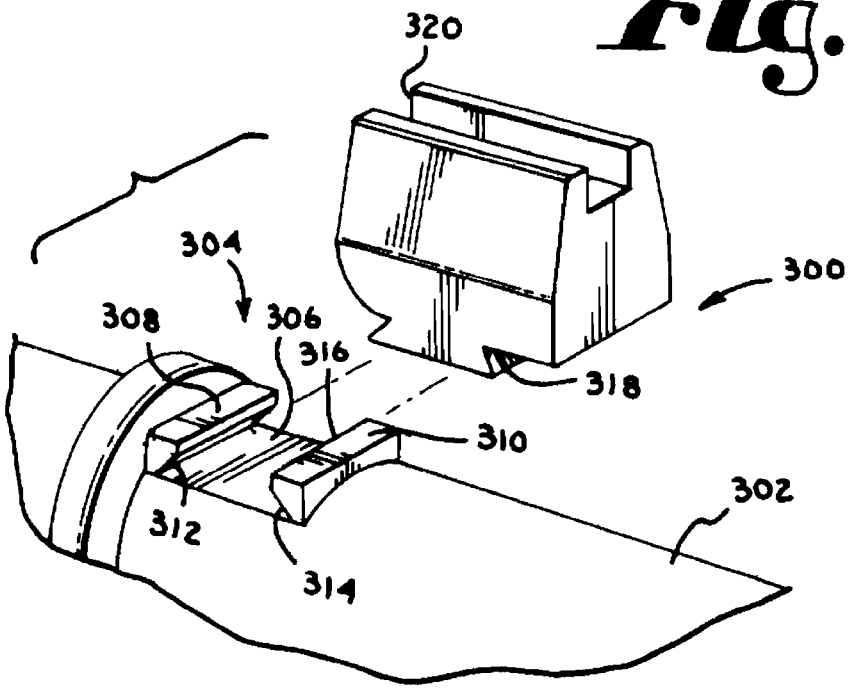
FIG. 9 is an exploded perspective view of an alternative embodiment of front support for mounting on a Saiga shotgun.

FIG. 9 shows an alternative embodiment of front support 300 in accordance with the present invention, which is operable to be mounted on a Saiga shotgun 302. The Saiga shotgun 302 has a sight housing 304 that is different from the sight housing 24 of firearm 12. The sight housing 304 is coupled with a receiver (not shown) of the shotgun 302 such that it extends at least partially above the receiver. The sight housing 304 includes a base 306 with two protrusions 308 and 310 integral with and extending upward from the base 306. The protrusions 308 and 310 include angled surfaces 312 and 314, respectively, which in combination with the base 306 form a female dovetail mount portion 316. The conventional rear sight of the Saiga shotgun (not shown) has a male dovetail mount portion that is received by the female dovetail mount portion 316. The conventional rear sight of the Saiga shotgun must be removed from the female dovetail mount portion 316 before front support 300 is installed.

Front support 300 is substantially similar to the front support 16 shown in FIG. 4 except that front support 300 does not include threaded hole 56, screw 58 or groove 62 and front support 300 has a male dovetail mount portion 318 extending downward from its base. The male dovetail mount portion 318 is sized and configured so that it may be received by the female dovetail mount portion 316 of the shotgun 302. Preferably, the male dovetail mount portion 318 is sized so that it fits tightly within the female dovetail mount portion 316 so that it is frictionally retained within the female dovetail mount portion 316. The front support 300 includes a groove 320 in its top surface that is sized for receiving rail 20 (FIG. 3), which may mount to the front support 300 in a similar manner as described above with respect to front support 16.

The left side of the shotgun's receiver preferably has a mounting structure (not shown) that is substantially similar to the mounting structure 202 shown in FIG. 6. Rear support 210 (FIG. 8) may mount to the mounting structure (not shown) of the shotgun's receiver in a similar manner as described above with respect to receiver 200. Rail 20 may mount to rear support 210 in a similar manner as described above with respect to rear support 18 so that the rail 20 is spaced above the top of the shotgun 302 and centered with respect to the shotgun 302. Accessories such as scope 14 (FIG. 1) may mount to rail 20 above shotgun 302 in a similar manner as described above. The front support 300, rail 20 and rear support 210 preferably stiffen the shotgun 302 in a similar manner as described above with respect to firearm 12.

In operation, scope mount 10 is mounted to firearm 12 by mounting front and rear supports 16 and 18 to the firearm 12 in the manner described above. Rail 20 is mounted to the front and rear supports 16 and 18 with screws 22*a-d*. Scope 14 is mounted to the rail 20 with scope rings 116*a-b* as is well known in the art. The scope 14 is aligned with the barrel 122 so that it is ready for firing. Because the scope mount 10 is spaced above dust cover 30, the dust cover 30 may be removed to service the firearm 12 without disturbing the scope 14. The scope mount 10 rigidly mounts to the sight housing 24 and receiver 26 of firearm 12 so that the scope mount 10 and scope 14 do not move as the firearm 12 is fired, which eliminates the need to realign the scope 14 after the firearm 12 is fired. The scope mount 10 also rigidly ties together the sight housing 24 and receiver 26 to stiffen the firearm 12 and prevent it from flexing and twisting as rounds are fired, which may improve the accuracy and durability of the firearm 12.

Rear support 210 (FIG. 8) may be substituted for rear support 18 as discussed above when mounting to a receiver such as the AK-47 receiver 200 shown in FIG. 6. When mounting to a Saiga shotgun 302 (FIG. 9), front support 300 may be used along with rail 20 and rear support 210. Further, it is within the scope of the invention for additional modifications to be made to the front supports 16 and 300, rail 20, and rear supports 18 and 210 as necessary to allow them to be mounted on a particular firearm.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A firearm scope mount operable to mount to a firearm comprising a receiver and a sight housing, comprising:

a rear support operable to mount to a side of the receiver;

a front support operable to mount to the sight housing; and a rail coupled with and extending between said front and rear supports, and wherein the firearm is a Kalashnikov series firearm.

2. The firearm scope mount of claim 1, wherein said rear support presents a groove that is operable to receive a protrusion of the receiver.

3. The firearm scope mount of claim 2, wherein said groove is a female dovetail joint portion and said protrusion is a male dovetail joint portion.

4. The firearm scope mount of claim 3, wherein said rear support comprises upper and lower sections, wherein said upper and lower sections in combination present said female dovetail joint portion, and wherein said upper and lower sections are operable to engage each other and clamp the male dovetail joint portion between said upper and lower sections.

5. The firearm scope mount of claim 1, wherein said rear support comprises a generally vertical portion that is operable to mount to the receiver, an angled portion that is coupled with and extends upward from said vertical portion, and a generally horizontal portion that is coupled with and extends from said angled portion, wherein said generally horizontal portion is operable to be positioned over a top of the receiver, and wherein said rail couples with said generally horizontal portion.

6. The firearm scope mount of claim 1, wherein said front support comprises a pair of generally vertical legs and a generally horizontal portion coupled with and extending between said legs, and wherein said rail couples with said generally horizontal portion.

7. The firearm scope mount of claim 6, wherein each of said legs comprises an opening that is operable to align with one of a pair of openings in the sight housing, and further comprising a pair of pins each operable to be received by said opening in one of said legs and one of said openings in the sight housing for mounting said front support to the sight housing.

8. The firearm scope mount of claim 7, wherein said pins comprise screws that engage threads in said front support.

9. The firearm scope mount of claim 1, wherein said front support comprises a male dovetail mount portion that is operable to be received by a female dovetail mount portion of the sight housing.

10. The firearm scope mount of claim 1, wherein said front and rear supports are operable to support said rail spaced a vertical distance above the receiver.

11. The firearm scope mount of claim 10, wherein said rail is spaced a vertical distance above the receiver to permit removal of a cover from a top of the receiver.

12. The firearm scope mount of claim 1, wherein said front support is operable to mount to the sight housing when the sight housing is coupled with the receiver and extends at least partially above the receiver.

13. The firearm scope mount of claim 1, wherein said front support is operable to mount to the sight housing when the sight housing is a tangent style rear sight housing.

14. The firearm scope mount of claim 1, wherein said front and rear supports and said rail are operable to stiffen the receiver.

15. The firearm scope mount of claim 1, wherein said rail is operable to support a scope weighing at least approximately four pounds and prevent the scope from becoming misaligned when the firearm is fired in fully automatic mode.

16. A firearm scope mount operable to mount to a firearm comprising a receiver and a sight housing, comprising:

a rear support operable to mount to a side of the receiver;

a front support operable to mount to the sight housing; and a rail coupled with and extending between said front and rear supports, wherein said rear support presents a groove that is operable to receive a protrusion of the receiver, and wherein said groove is a female dovetail joint portion and said protrusion is a male dovetail joint portion.

17. A firearm scope mount operable to mount to a firearm comprising a receiver and a sight housing, comprising:

a rear support operable to mount to a side of the receiver;

a front support operable to mount to the sight housing, wherein said front support comprises a pair of generally vertical legs and a generally horizontal portion coupled with and extending between said legs, wherein each of said legs comprises an opening that is operable to align with one of a pair of openings in the sight housing;

a pair of pins each operable to be received by said opening in one of said legs and one of said openings in the sight housing for mounting said front support to the sight housing; and a rail coupled with and extending between said front and rear supports, wherein said rail couples with said generally horizontal portion of said front support.

18. A firearm scope mount operable to mount to a firearm comprising a receiver and a sight housing, comprising:

a rear support operable to mount to a side of the receiver;

a front support operable to mount to the sight housing; and a rail coupled with and extending between said front and rear supports, wherein said front and rear supports are operable to support said rail spaced a vertical distance above the receiver, and wherein said rail is spaced a vertical distance above the receiver to permit removal of a cover from a top of the receiver.

* * * * *